US006688127B2

(12) United States Patent
Laubacher et al.

(10) Patent No.: US 6,688,127 B2
(45) Date of Patent: Feb. 10, 2004

(54) CRYOGENIC DEVICES

(75) Inventors: Daniel B. Laubacher, Wilmington, DE (US); Zhi-Yuan Shen, Wilmington, DE (US); Philip Shek Wah Pang, Media, PA (US); Alan Lauder, Kennett Square, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 21 days.

(21) Appl. No.: 10/187,545

(22) Filed: Jul. 2, 2002

(65) Prior Publication Data

US 2002/0178742 A1 Dec. 5, 2002

Related U.S. Application Data

(63) Continuation-in-part of application No. 09/948,498, filed on Sep. 7, 2001.

(60) Provisional application No. 60/230,682, filed on Sep. 7, 2000, and provisional application No. 60/265,917, filed on Feb. 2, 2001.

(51) Int. Cl.[7] ..... F25D 23/12

(52) U.S. Cl. ..... 62/259.2

(58) Field of Search ..... 62/259.2, 51.1

(56) References Cited

U.S. PATENT DOCUMENTS

| | | | | |
|---|---|---|---|---|
| 4,962,083 | A | 10/1990 | Hermann et al. | |
| 5,017,554 | A | 5/1991 | Subramanian | |
| 5,616,538 | A | 4/1997 | Hey-Shipton et al. | |
| 6,104,934 | A | 8/2000 | Patton et al. | |
| 2003/0084677 | A1 * | 5/2003 | Kagaya et al. | 62/259.2 |

FOREIGN PATENT DOCUMENTS

| | | |
|---|---|---|
| EP | 0281753 | 1/1988 |
| WO | WO 8805029 | 7/1988 |

* cited by examiner

*Primary Examiner*—Melvin Jones

(57) ABSTRACT

This invention relates generally to cryogenic devices and, more particularly, to cryogenic devices of very small size based on superconducting elements, low thermal transmission interconnects and low dissipated power semiconductor

42 Claims, 15 Drawing Sheets

CRYOGENIC DEVICES

CROSS REFERENCE TO RELATED APPLICATIONS

This application is a continuation-in-part of U.S. Ser. No. 09/948,498, filed on Sep. 7, 2001, which claims priority under 35 U.S.C. §119 from U.S. Provisional Appln. Ser. No. 60/230,682, filed Sep. 7, 2000, and U.S. Provisional Appln. Ser. No. 60/265,917, filed Feb. 2, 2001, all of which are incorporated by reference herein as if fully set forth.

BACKGROUND OF THE INVENTION

1. Field of the Invention

This invention relates generally to cryogenic front-end receivers and, more particularly, to cryogenic front-end receivers of minimal size based on super-conducting elements, low thermal transmission interconnects, self-resonating filters and low dissipated power profile.

2. Description of the Related Art

Until the late 1980s, the phenomenon of superconductivity found very little practical application due to the need to operate at temperatures in the range of liquid helium. In the late 1980s ceramic metal oxide compounds containing rare earth elements began to radically alter this situation. Prominent examples of such materials include YBCO (yttrium-barium-copper oxides, see WO88/05029 and EP-A-0281753), TBCCO (thallium-barium-calcium-copper oxides, see U.S. Pat. No. 4,962,083) and TPSCCO (thallium-lead-strontium-calcium-copper oxides, see U.S. Pat. No. 5,017,554). All of the above publications are incorporated by reference for all purposes as if fully set forth herein.

These compounds, referred to as HTS (high temperature superconductor) materials, exhibit superconductive properties at temperatures sufficiently high enough to permit the use of liquid nitrogen as a coolant. Because liquid nitrogen at 77 K (196° C./321° F.) cools twenty times more effectively than liquid helium and is ten times less expensive, a wide variety of potential applications began to hold the promise of economic feasibility. For example, HTS materials have been used in applications ranging from diagnostic medical equipment to particle accelerators.

Currently one of the fastest growing applications for superconductivity lies in the area of electronics and associated microwave engineering, due to the astronomical growth in the telecommunications industry and the increased use of consumer electronics by the general population. In spite of the recent advances in superconductivity, however, size, cost and power requirements have limited the commercial use of this promising technology in all but high-end applications such as space instrumentation and military applications.

An essential component of many electronic devices, and particularly in the communications field, is the filter element. HTS filters have significant advantages in extremely low in-band insertion loss, high off-band rejection and steep skirts due to the extremely low radio frequency (RF) loss in the HTS materials.

However, the conventional transmission line HTS filters, having conventional HTS resonators (such as strip line resonators) as building blocks, require a large substrate area due to the area requirement that at least one dimension of the resonator be equal to approximately half a wavelength (i.e. $\lambda/2$). See, for example, U.S. Pat. No. 5,616,538 (incorporated by reference for all purposes as if fully set forth herein). Thus, in conventional low frequency HTS filters having multiple poles and coupled with conventional semiconductor electronic components, such as gallium arsenide (GaAs) amplifiers, the cryogenic coolers required to cool the HTS materials to below their critical temperature ($T_c$) are relatively large and require heat lifts of at least 6 watts at 80 K at an ambient temperature of 20° C.

FIG. 1 is a perspective view of such a conventional prior art cryogenic receiver. The overall integrated package consists of several distinct elements. The connectors 110 are used for bringing power and RF signals in and out of the cryoelectronic section, which consists of a dewar assembly 120 containing cryoelectronic components 130 such as RF filters and amplifiers. The dewar assembly 120 is the vacuum cavity necessary to reduce convective heat loading to the cryoelectronic components from molecules within the dewar assembly 120. A cryogenic source, in this case a cooler 140, provides the cooling for the cryoelectronic section. The enclosure 150 is an outer package containing the previously described elements as well as circuit boards 160 which provide control functions for the cooler and other error or failure detection and alarms, and a fan 170 for cooling the circuit boards 160.

The size of a conventional unit, as illustrated in FIG. 1, is typically on the order of at least about 15 inches wide×20 inches long×10 inches deep (about 38.1×50.8×25.4 cm). The large size and weight of these conventional units stems predominately from the cooling required due to the physical size of the cryoelectronic section, the power required for the amplifiers, and additional convective heat flow from the RF transitions (normally coaxial cables with connectors), from ambient conditions into the dewar assembly 120. The physical size, weight and total operating power supplied to the unit is thus dominated by the cooler 140 and dewar assembly 120. For the conventional unit, the cooling lift required per channel is about 1 W when operated at 20° C., thus the total operational power needed for the cooler 140 alone is >125 W.

Examples of conventional units are the Superfilter™ Systems available from Superconductor Technologies Inc., Santa Barbara, Calif. (see www.suptech.com for more information), and the ClearSite™ systems available from Conductus Inc., Sunnyvale, Calif. USA (see www.conductus.com for more information).

The large size and weight of these conventional units substantially limits the application of this technology. One such application is a tower top application in which a receiver front-end is mounted onto an antenna of a cellular or similar base station, such as those disclosed in U.S. Pat. No. 6,104,934 (incorporated by reference for all purposes as if fully set forth herein). The size and cooling requirements of the disclosed receiver are such that the cooling unit must be placed somewhere adjacent the antenna, and is not combinable with the electronics into an integrated unit.

For miniaturization purposes, the components comprising the greatest real estate needed are the cooler 140, cryoelectronic components 130 and dewar assembly 120.

One way to reduce the real estate requirements of a cryoelectronic front-end receiver is to employ lumped element architecture based on conventional HTS filters. These filters can be made to operate at frequencies below 5 GHz with a somewhat more compact physical size; however, filter performance of these conventional lumped element HTS filters is generally limited by intermodulation products and insertion loss.

The use of devices containing HTS filters presents other design problems. For example, the interconnects typically utilized to connect the cryogenic portion of the device (usually a dewar containing the HTS filter under vacuum) to other electronic components are long coaxial cables. These long cables, because of their length, exhibit low thermal transmission, which is highly desirable in a cryogenic system where keeping components cold is critical. However, these long cable lines also exhibit RF losses, thus contributing to degradation in RF performance (i.e. an increase in the signal-to-noise ratio). To compound problems even further, the long cables also require the dewar of the cryogenic portion of the device to be larger in volume, which requires a design capable of maintaining the vacuum necessary over the life of the unit, which is more difficult to achieve.

There has been a long felt need, as well as numerous attempts by persons of ordinary skill in the art, to reduce the size of filter elements constructed of HTS materials. U.S. Pat. No. 6,108,569, incorporated by reference herein for all purposes as if fully set forth, discloses the use of self-resonant spiral resonators to reduce the size of HTS material filters and concurrently solves cross-talk and connection problems. In spite of the great potential for miniaturization afforded by significant recent technological advances, the problems of vacuum degradation, high thermal transmission, and high dissipated power semiconductor devices, have resulted in less than optimum performance and yielded increased cooling costs.

Furthermore, conventional cryogenic front-end receivers require substantial time to manually tune the filters comprising a critical function of the unit. Since the resonating filters in a conventional filter construction do not each vary in a lock-stepped fashion, each pole of the filter must be individually tuned and the tuning of each pole affects every other pole in the filter array. The tuning process can typically take days to perform.

Moreover, conventional cryogenic front-end receivers also require the outgassing of molecules that adhere to the device walls during the manufacturing process. Typically, this problem is overcome by simply heating the device slowly over an extended period of time to outgas the gases, such as residual oxygen, nitrogen, carbon dioxide, argon, water vapor. The process normally takes days to complete, because the temperatures necessary to outgas the device walls in a short time period would damage the compressor motor comprising part of the cryogenic unit.

The prior art lacks a cryogenic front-end receiver of reduced size capable of being employed adjacent to or integrated with a receiver and/or transmitter.

The prior art also lacks a cryogenic front-end receiver with interconnections between the dewar and the cryogenic coolers exhibiting an extremely low thermal transmission to further thermally isolate the dewar.

The prior art additionally lacks a cryogenic front-end receiver having interconnections employing a thermal break material and a self-tuning reduced length for reducing RF losses and improving degradation in RF performance.

The prior art further lacks a cryogenic front-end receiver having reduced power consumption capabilities.

The prior art lacks a cryogenic front-end receiver employing reduced substrate size resonating filters made of HTS materials and resonating at frequencies below 5 GHz.

The prior art lacks a method for outgassing a vacuum dewar employing differential heating of the dewar assembly.

The prior art lacks a cryogenic front-end receiver capable of being tuned by varying the internal operating temperature of the front-end receiver.

SUMMARY OF THE INVENTION

The present invention has been made in view of the above circumstances and has as an aspect a cryogenic front-end receiver.

A further aspect of the present invention can be characterized as a cryogenic device, the device including a cryogenic electronic portion and a non-cryogenic electronic portion further including a thermal break section.

To achieve these and other advantages and in accordance with the purpose of the present invention, as embodied and broadly described, the present invention can be characterized, according to one aspect, as a cryogenic front-end unit, the unit including a cryogenic electronic unit, wherein the cryogenic unit includes a input signal interface and output signal interface. A cryogenic cooler is in thermal communication with the cryogenic electronic unit. The cryogenic unit further includes an input signal interconnect that is connected to the input signal interface and an output signal interconnect that is connected to the output signal interface.

Another aspect of the present invention can be characterized as a cryogenic device including a cryogenic electronic portion, a non-cryogenic electronic portion and an interconnect connecting the cryogenic and non-cryogenic electronic portions, wherein the interconnect comprises a thermal break between cryogenic and non-cryogenic electronic portions.

A further aspect of the present invention can be characterized as a cryogenic device including a cryogenic electronic portion contained within a vacuum dewar assembly, the cryogenic electronic portion having an input end and an output end, and an ambient to cryogenic input connector having an ambient end passing through the vacuum dewar assembly to a cryogenic end connected to the input end of the cryogenic electronic portion. A cryogenic to ambient output connector with a cryogenic end connected to the output end of the cryogenic electronic portion, passes through the vacuum dewar assembly to an ambient end. A cryogenic source is connected to the vacuum dewar assembly so as to be in intimate contact with the cryogenic electronic portion, which has an input end and an output end. The cryogenic electronic portion includes at least one of a high temperature superconductor filter element and a cryogenic active semiconductor circuit (such as a low-noise amplifier). The input end of the cryogenic electronic portion is connected to the cryogenic end of the input connector and the output end of the cryogenic electronic portion is connected to the cryogenic end of the output connector. In the event that an active semiconductor circuit is used, that active semiconductor circuit should produce a total dissipated power into the cryogenic electronic portion of less than about 850 mW. The cryogenic device has a maximum cooler lift of less than about 3 W at 80 K at an ambient temperature of 20° C.

Stated another way, this aspect of the present invention relates to a cryogenic device comprising:

(1) a cryogenic electronic portion contained within a vacuum dewar assembly, the cryogenic electronic portion having an input end and an output end;

(2) an ambient to cryogenic input connector having an ambient end passing through the vacuum dewar assembly to a cryogenic end connected to the input end of the cryogenic electronic portion, (3) a cryogenic to ambient output connector having a cryogenic end connected to the output end of the cryogenic electronic portion, passing through the vacuum dewar assembly to an ambient end; and (4) a cryogenic source connected to the vacuum dewar assembly so as to be in intimate contact with the cryogenic electronic portion, wherein:

(i) the cryogenic electronic portion comprises at least one of a high temperature superconductor filter element and a cryogenic active semiconductor circuit, (ii) an active semiconductor circuit, if present, produces a total dissipated power into the cryogenic electronic portion of less than about 850 mW, and (iii) the cryogenic device has a maximum cooler lift of less than about 3 W at 80 K at an ambient temperature of 20° C.

Another aspect of the present invention can be characterized as a cryogenic receiver in which the cryogenic electronic portion of the above-mentioned cryogenic device comprises a high temperature superconductor filter element having an input end and an output end, and an active semiconductor circuit having an input end and an output end, wherein the input end of the active semiconductor circuit is connected to the cryogenic end of the input connector via the high temperature superconductor filter element. The input end of the filter element is connected to the cryogenic end of the input connector and the output end of the filter element is connected to the input end of the active semiconductor circuit.

Stated another way, this other aspect relates to a cryogenic receiver in which the cryogenic electronic portion of the above-mentioned cryogenic device comprises a high temperature superconductor filter element having an input end and an output end, and an active semiconductor circuit having an input end and an output end, wherein:

the input end of the active semiconductor circuit is connected to the cryogenic end of the input connector via the high temperature superconductor filter element;

the input end of the filter element is connected to the cryogenic end of the input connector; and the output end of the filter element is connected to the input end of the active semiconductor circuit.

A still further aspect of the present invention can also be characterized as a cryogenic receiver including a cryogenic electronic portion contained within a vacuum dewar assembly, the cryogenic electronic portion having an input end and an output end. An ambient to cryogenic input connector having an ambient end passes through the vacuum dewar assembly to a cryogenic end connected to the input end of the cryogenic electronic portion, and a cryogenic to ambient output connector having a cryogenic end connected to the output end of the cryogenic electronic portion passes through the vacuum dewar assembly to an ambient end. The cryogenic receiver further comprises a cryogenic source connected to the vacuum dewar assembly so as to be in intimate contact with the cryogenic electronic portion. The cryogenic electronic portion additionally includes a high temperature superconductor filter element having an input end and an output end, and an active semiconductor circuit having an input end and an output end. The input end of the filter element is connected to the cryogenic end of the input connector and the output end of the filter element is connected to the input end of the active semiconductor circuit. The output end of the active semiconductor circuit is connected to the cryogenic end of the output connector and the active semiconductor circuit produces a total dissipated power into the cryogenic electronic portion of less than about 850 mW. The cryogenic receiver has a maximum cooler lift of less than about 3 W at 80 K at an ambient temperature of 20° C.

Stated another way, this still further aspect of the present invention also relates to a cryogenic receiver comprising:

(1) a cryogenic electronic portion contained within a vacuum dewar assembly, the cryogenic electronic portion having an input end and an output end;

(2) an ambient to cryogenic input connector having an ambient end passing through the vacuum dewar assembly to a cryogenic end connected to the input end of the cryogenic electronic portion, (3) a cryogenic to ambient output connector having a cryogenic end connected to the output end of the cryogenic electronic portion, passing through the vacuum dewar assembly to an ambient end; and (4) a cryogenic source connected to the vacuum dewar assembly so as to be in intimate contact with the cryogenic electronic portion, wherein:

(i) the cryogenic electronic portion comprises:

(a) a high temperature superconductor filter element having an input end and an output end, and (b) an active semiconductor circuit having an input end and an output end, (ii) the input end of the filter element is connected to the cryogenic end of the input connector, (iii) the output end of the filter element is connected to the input end of the active semiconductor circuit, (iv) the output end of the active semiconductor circuit is connected to the cryogenic end of the output connector, (v) the active semiconductor circuit produces a total dissipated power into the cryogenic electronic portion of less than about 850 mW, and (vi) the cryogenic receiver has a maximum cooler lift of less than about 3 W at 80 K at an ambient temperature of 20° C.

The reader should note that when one "component" is connected to another "component," only a sequence is implied and, as such, other components may be connected in between. For example, input connector-filter element-active semiconductor-output connector is a sequence that can be interrupted by other components. It is generally accepted practice to keep the number of components in the vacuum dewar assembly to a minimum (e.g., to reduce cooling requirements), so it is desirable to have a direct connection from the input connector to the filter element, the filter element to the active semiconductor device, and the active semiconductor device to the output connector, as discussed in further detail below.

With the combination of the HTS filters (particularly those based on self-resonating spiral resonators), low dissipated power semiconductor devices (that operate effectively under the required cryogenic conditions) and the interconnects as mentioned above, much smaller cryogenic devices (such as low noise receivers) can be constructed and cooled by smaller cryogenic since these devices require cooler lifts of less than about 3 watts, more preferably less than about 2 watts, and still more preferably about 1 watt or less, to cool the cryoelectronic section to 80 K at an ambient temperature of 20° C. In other words, the present invention provides miniature cryogenic devices delivering optimum performance at minimal size and cooling cost.

An additional benefit to the miniaturization enabled by the present invention is a significant reduction in the heat budget of the operating unit, which has a direct correlation to improved cryocooler efficiency, increased system operational life and reliability, and reduced energy consumption and operating costs.

The present invention also provides a method of tuning a cryogenic receiver comprising a high temperature superconducting filter element, said cryogenic receiver being programmed to operate at a specified operating frequency at a specified temperature, comprising the step of altering the specified operating temperature to induce a shift in the operating frequency of the cryogenic receiver.

This invention also provides a communications tower having an integrated antenna assembly located at the top of the tower, and a telecommunications network utilizing such a communications tower.

These and other features and advantages of the present invention will be more readily understood by those of ordinary skill in the art from the following detailed description. It is to be understood that both the foregoing general description and the following detailed description are exemplary and explanatory only and are not restrictive of the invention, as claimed. For example, it is to be appreciated that certain features of the invention which are, for clarity, described below in the context of separate embodiments, may also be provided in combination in a single embodiment. Conversely, various features of the invention which are, for brevity, described in the context of a single embodiment, may also be provided separately or in any subcombination.

BRIEF DESCRIPTION OF THE DRAWINGS

The accompanying drawings, which are incorporated in and constitute a part of this specification, illustrate several embodiments of the invention and together with the description, serve to explain the principles on of the invention.

DETAILED DESCRIPTION OF THE PREFERRED EMBODIMENTS

Reference will now be made in detail to the present embodiments of the present invention, and examples of which are illustrated in the accompanying drawings. Wherever possible, the same reference numbers will be used throughout the drawings to refer to the same or like parts (elements).

The present invention overcomes the deficiencies of the prior art as stated above and provides technical advantages over the prior art in the areas of receiver size, power requirement, thermal isolation, integration with a receiver or transmitter and interconnections of reduced length for reducing RF losses.

It should be noted that the word "ambient", as used herein, refers to conditions present in the surrounding environment, that is, external to the dewar assembly. Ambient can, for example, refer to normal room conditions, elevated temperature conditions present as a result of a warm day and/or heat generated in the operation of the equipment, or low temperature conditions existing in outer space. This is opposed to "cryogenic" which refers to conditions within the dewar assembly, that is, an environment that is purposefully cooled (with a cryogenic source) to maintain a desired low temperature for optimal operation of the cryogenic electronic portion.

Figure 2:
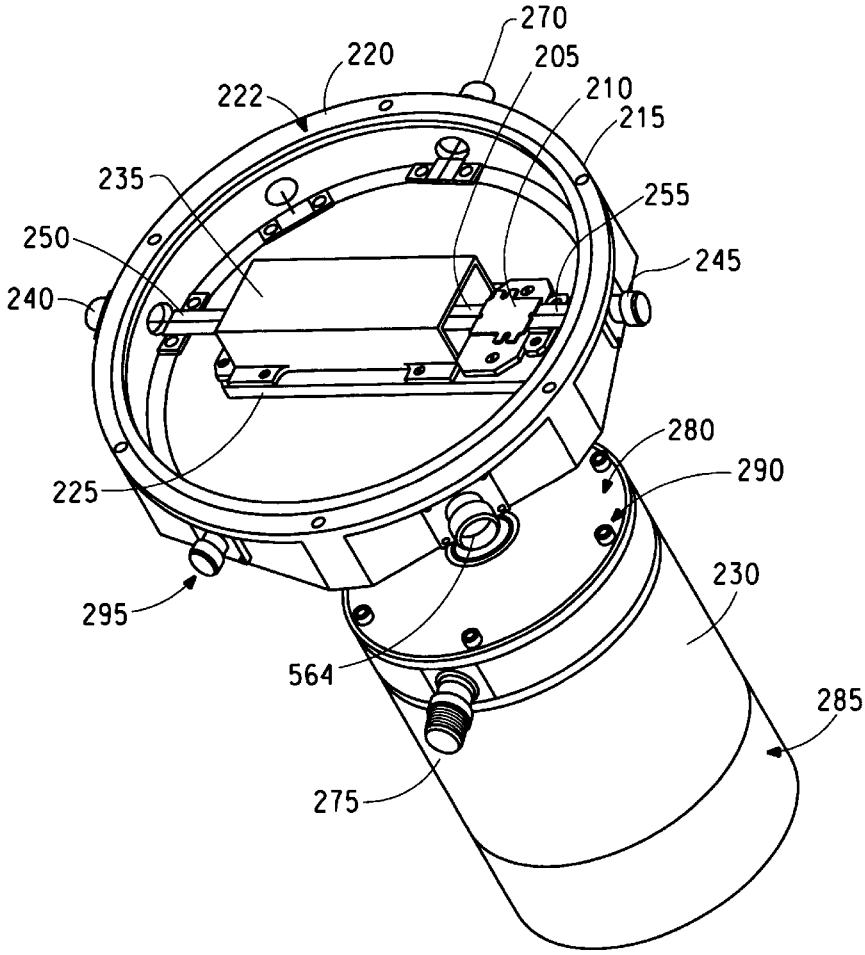
FIG. 2 shows a front tilt perspective view of an embodiment of a cryogenic receiver in accordance with the present invention.
Figure 5A:
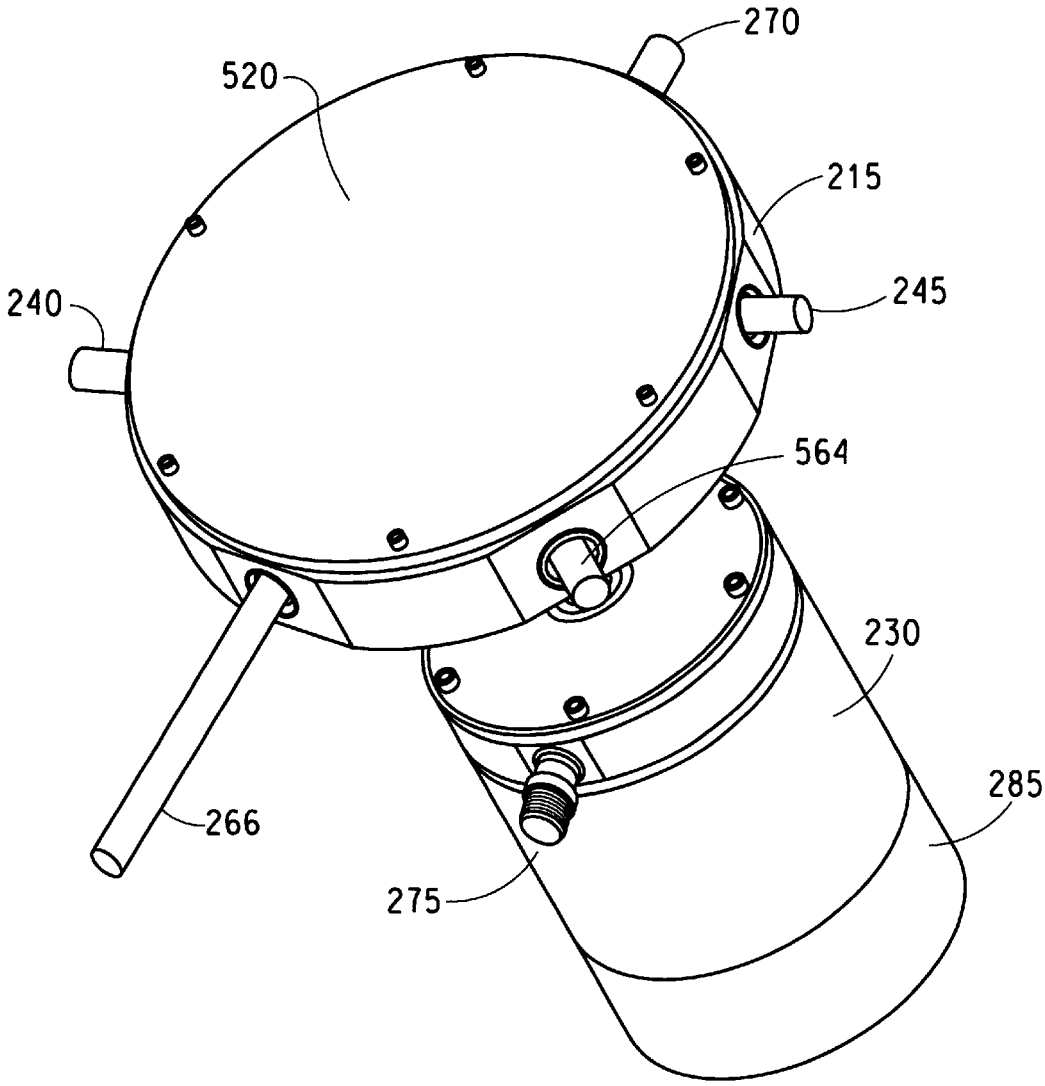
FIG. 5A shows a front-tilted perspective view of a hermetically sealed cryogenic receiver of an embodiment of the present invention.

An improvement in the current state of the art, in accordance with the present invention, is shown in FIGS. 2, 2A and 5A–5E. Depicted is a cryogenic receiver in which the cryogenic electronic portion is, for illustration purposes, a combination of an HTS filter element 205 connected to an active semiconductor circuit 210, and contained in a vacuum dewar assembly 215. The vacuum dewar assembly 215 comprises a body 220 and, as a base, bottom plate 565. A cold plate 225 is in intimate contact or in close proximity to both the cryogenic electronic portion and a cryogenic source. In this embodiment the cryogenic source is a miniature cryocooler 230. The vacuum dewar assembly 215 is a self-contained unit comprising a housing or enclosure. Vacuum dewar assembly 215 includes a cover or lid 520, as shown in FIG. 5A. Generally speaking, the vacuum dewar assembly 215 and cryocooler 230 are in close proximity to one another. In an alternate embodiment, vacuum dewar assembly 215 and cryocooler 230 are in close proximity with each other or formed as an integral unit or assembly (affixed to one another) as depicted in FIG. 2.

The vacuum dewar assembly 215 may also contain, for example, a thermal/infrared heat shield 235 covering at least the HTS filter element 205, to further reduce the cooling and power requirements of the cryogenic device.

In another embodiment the size of the cryogenic device can be further reduced by placing a superconducting plate (not depicted) on the underside of thermal/infrared heat shield 235 facing at least the HTS filter element 205 and further in intimate contact with cold plate 225. The application of the superconducting plate in the present embodiment assists in providing reduced surface area for the cryogenic device element and thus further reduce the cooling and power requirements of the device.

The superconducting plate can comprise, for example, a disk with a film of an HTS material on at least the side of the disk facing the HTS filter element 205. The disk typically is not in physical contact with the HTS filter element 205, but can be as close to HTS filter element 205 without contact as the construction of the dewar assembly allows. In order to be in contact with cold plate 225 but not HTS filter element 205, the disk can contain one or more spacer legs or edges. Generally, the disk covers as much of the cryogenic electronic portion as the construction of the dewar assembly allows.

The superconducting plate can also be used for tuning purposes such as, for example, disclosed in U.S. application Ser. No. 09/727,009 (filed Nov. 30, 2000) (corresponding to WO01/41251), which is incorporated by reference for all purposes as if fully set forth herein.

A method that can be used for tuning is to modify the temperature at which the unit is programmed to operate. For instance, the difference in temperature in a unit operating at 79.5 K versus 80.0 K can, depending on filter design, introduce a shift in the operating frequency of the HTS filter element 205 of up to 200 kHz. This temperature adjustment can be made by varying the set point temperature of the temperature controller for the cryocooler 230. Another way of adjusting this temperature is to modify the temperature voltage curve of a temperature measurement silicon diode or Resistive Temperature Device (RTD) in the controller or adding an additional resistance in series with the RTD or silicon diode and leaving the voltage curve fixed.

In an alternate embodiment the operating temperature of the cryogenic unit can be varied such that the unit could operate at a second center frequency for emergency or back-up purposes in narrow band applications. For instance, if a unit is designed to operate at 1950 MHz center point frequency with a bandwidth of 2 MHz, the operational range would be 1949–1951 MHz. By varying the operating temperature, the unit can be made to operate at center point frequency of 1949 MHz with a bandwidth ranging from 1948–1950 MHz. The temperature can also be varied in smaller increments to fine tune the cryogenic unit, wherein the unit is operating slightly off center of its intended center point frequency due to variations in the manufacturing process. The center point frequency is the frequency at the midpoint of the operating bandwidth. This tuning of a cryogenic unit, e.g., a cryogenic receiver, by adjusting the operating temperature, thereby shifting the center point frequency and operating bandwidth of the high temperature superconductor filter element, can be especially useful in correcting for the variations in the manufacturing process. While a filter can be designed to operate at an intended center point frequency at a convenient operating temperature, it can be difficult to repeatedly manufacture the filter with the precise dimensions needed to operate at that frequency. The appropriate adjustment of the operating temperature will shift the center point frequency to the intended frequency and thereby compensate for the variations in the manufacturing process. Raising the operating temperature raises the inductance of the filter and therefore lowers the frequency; lowering the operating temperature lowers the inductance of the filter and therefore raises the frequency. Either adjustment can be made, and such an adjustment provides a rapid method for tuning the high temperature superconductor filter element and a cryogenic receiver containing such a filter element. In a manufacturing method, it is preferred to start with a filter element having a center point frequency higher than intended and to raise the operating temperature to lower the frequency. Therefore, to insure a good yield of manufactured filter elements operating at the intended center point frequency, the filter elements are designed to operate at a slightly higher center point frequency. As a result it can be expected that the filter elements produced using this design will have center point frequencies in a range slightly above the intended frequency. Each filter element and each cryogenic receiver containing such a filter element can subsequently be individually fine tuned to adjust the center point frequency to the desired frequency by slightly raising the operating temperature.

Figure 2A:
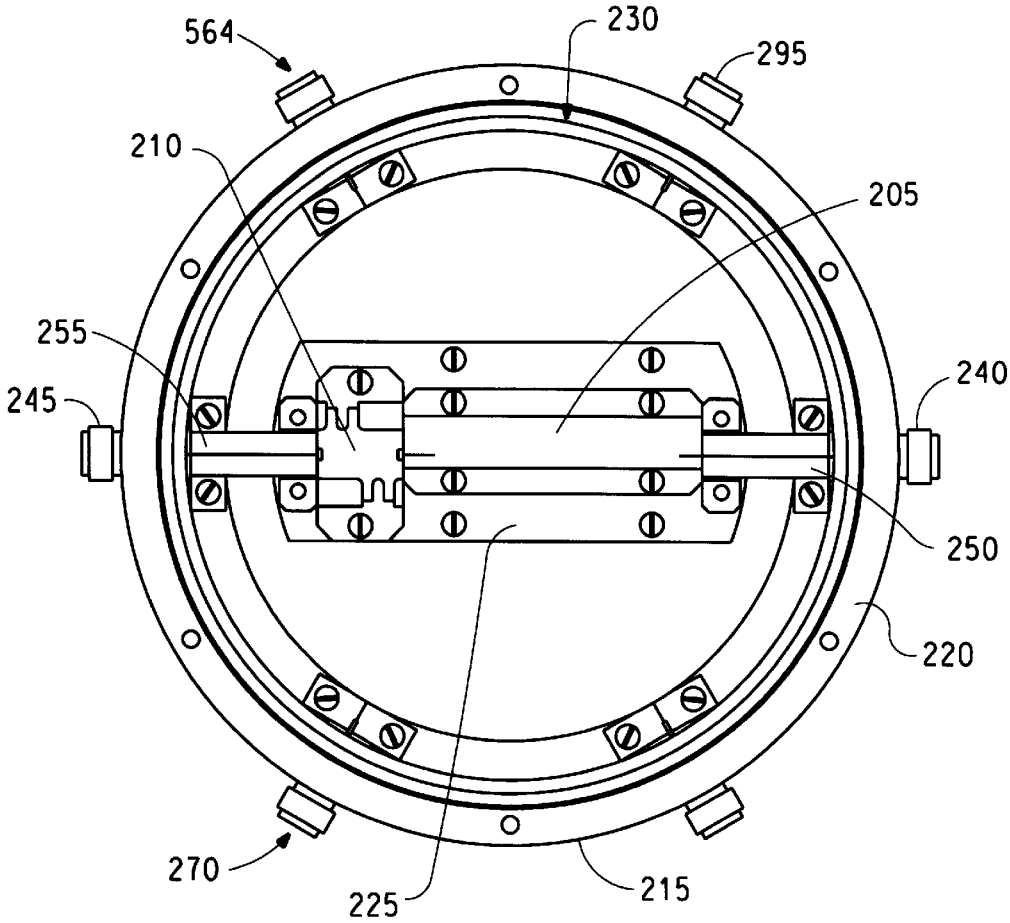
FIG. 2A shows a top perspective view of an embodiment of a cryogenic receiver in accordance with the present invention.

The cryogenic electronic portion is connected to input sources and output components, as illustrated in FIGS. 2, 2A and 5A, through, respectively, input and output connectors 240 and 245, which transition from cryogenic conditions within the vacuum dewar assembly 215 to ambient conditions outside the vacuum dewar assembly 215.

As indicated above, the total cooling power required by the cryogenic electronic portion directly affects the size, weight and total operating power of a cryocooler functioning as the cryogenic source. The larger the total cooling power required, the larger the size, weight and total operating power of the cooler. The total cooling power required is a function of a number of factors including, but not limited to, the infrared heating of the cold surfaces, conductive heat flow by gas molecules from warm surfaces to the cold surfaces, the power dissipated by the active semiconductor circuit 210 into the vacuum dewar assembly 215, and the conductive heat leak due to the connectors 240 and 245 and the jumpers 250 and 255. Infrared heating of the cold surfaces can be reduced by altering the size of the cold surfaces and the temperature at which the cold surfaces are held relative to ambient. The size of the cold surfaces is determined primarily by filter size and packaging.

In addition to the features detailed above, the present invention, as depicted in FIGS. 2 and 2A, employs a number of other features to reduce the size and total cooling power required to maintain the cryogenic electronic portion at an optimal operating temperature.

Figure 1:
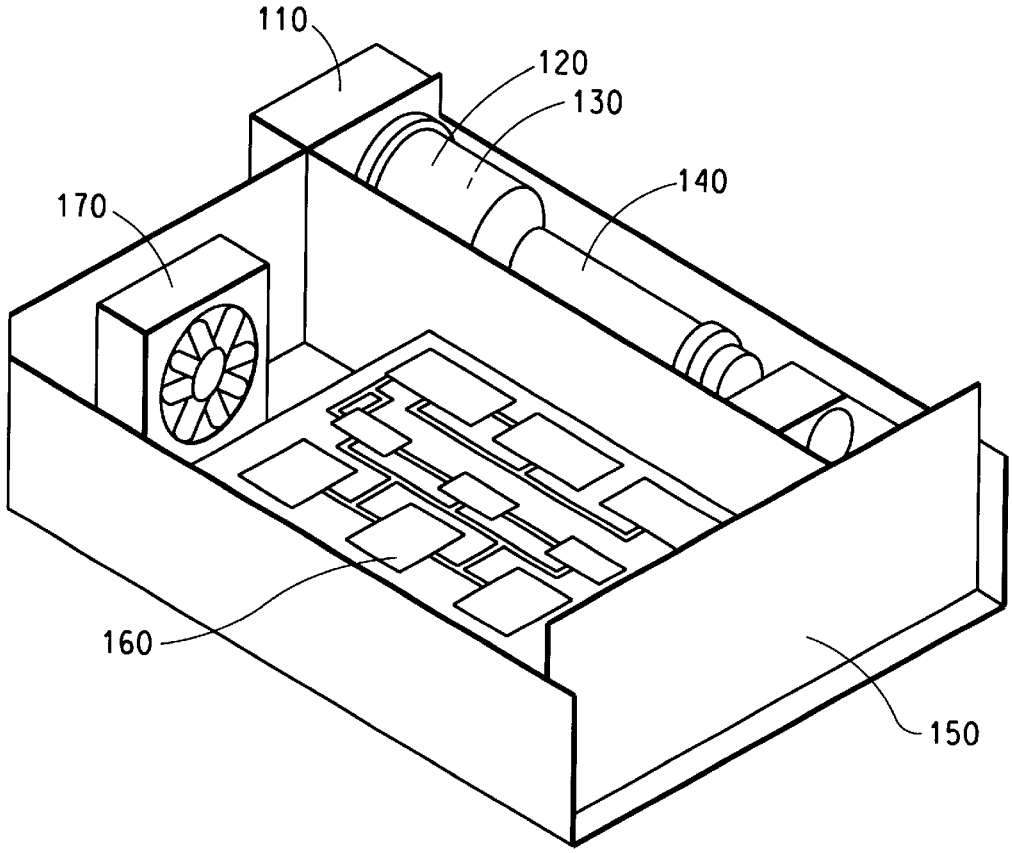
FIG. 1 (PRIOR ART)
FIG. 1 shows a perspective view of a conventional integrated cryogenic receiver.

As can be seen from FIGS. 2 and 2A, the connectors 240 and 245 are made integral to the vacuum dewar assembly 215 as opposed to a separate module 110 as depicted in Prior Art FIG. 1. The jumpers 250 and 255 are connected, respectively, to input and output hermetic connectors 240 and 245. The hermetic connectors 240 and 245 provide the electrical transition into and out of the vacuum dewar assembly 215 and utilize, for example, "O"-rings, soldered seals and/or direct glass to metal seals to maintain the vacuum seal within the vacuum dewar assembly 215. Direct glass to metal seals generally provide a suspension seal. The portion of hermetic connectors 240 and 245 outside of the dewar assembly can, for example, be in the form of coaxial or other well-known connectors, such as fiber-optics, twisted pairs and the like, depending on the type of connection required. Use of a fiber optic connection would require conversion of the RF signal to an encoded light signal.

Jumpers 250 and 255 transition from cryogenic temperatures at the connections to the cryogenic components to ambient temperatures at the connections to the hermetic connectors 240 and 245. The jumpers 250 and 255 can be of conventional construction, depending on the end use, for example, a microstrip transmission line for lower frequency signals or a waveguide for higher frequency signals. In an alternate embodiment the interconnects (i.e. jumpers 250 and 255) are formed on a thermal break material to reduce thermal gain from the ambient. For example, jumpers 250 and 255 can be formed as a microstrip transmission line on a substrate such as alumina, glass (fused silica, quartz or MACOR), fiberglass epoxy, or aerogel whose thickness is >0.002 inches (>0.051 mm). The substrates for the jumpers utilized in the present invention are constructed of very low thermal conductive materials that function as effective thermal breaks, such as fused silica (thermal conductivity (K) of about 1.5 W/m-K) or silica-based aerogels (K values of from about 0.02 W/m-K (300 K, 1 atmosphere) to 0.004 W/m-K (300 K, vacuum)). In an alternate embodiment higher thermal conductivity substrates are contemplated that also include a thermal break material of some type. Skilled artisans will appreciate that numerous thermal breaks may be employed and not depart from the teachings of the present invention.

Figure 3:
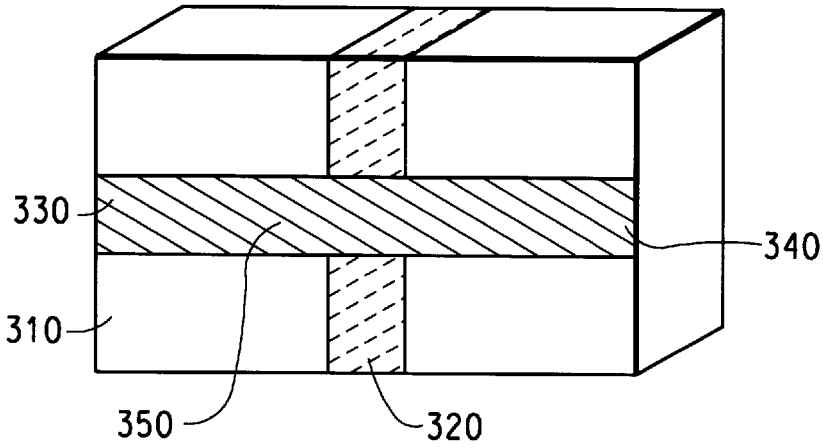
FIG. 3 is a diagram of a microstrip transmission line with a thermal break that can be used as part of an ambient to cryogenic (or vice versa) connector.
Figure 4:
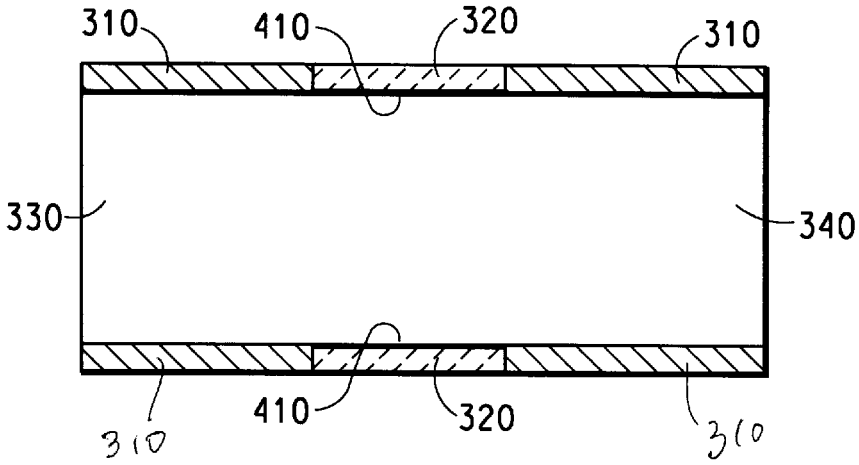
FIG. 4 is a diagram of a waveguide structure with a thermal break that can also be used as part of an ambient to cryogenic (or vice versa) connector.

An example of this embodiment is depicted in FIG. 3, wherein an interconnect includes an inserted thermal break. Substrate material 310 contains an insert 320 of a low thermal conductivity material (such as aerogel) between the colder end 330 and warmer end 340 of the conductive strip 350 on the microstrip line. In a similar context, a waveguide cavity can be constructed of a low thermal conductive material such as aerogel that is metallized on at least the interior surface, or can be constructed of a standard material such as a metal with an inserted thermal break. An embodiment of the inserted thermal break material in a metallic waveguide is depicted in FIG. 4, where substrate material 310 contains an insert 320 of a low thermal conductive material (such as aerogel), metallized on at least the interior surface 410, between the colder end 330 and warmer end 340 of the waveguide cavity.

It should be noted that, while thermal breaks additionally reduce thermal conductivity from the ambient, low thermal conductivity materials should be utilized as the primary means to avoid as much conductive heat gain in the cryogenic electronic portion as possible. A combination of low thermal conductivity materials and well as the application of a thermal breaks in the design generally provides the best of both, but at a cost of increased size and thus may not be practical in all applications.

Because conductive heat flow is inversely proportional to the length of the conductive material, jumpers 250 and 255 (see FIG. 5D) can be lengthened, although this may lead to increased signal losses and an increase in the size of the vacuum dewar assembly. The trade off between RF loss and lower thermal gain, however, can be optimized by the person of ordinary skill in the art based on the materials and dimensions of construction of the jumpers 250 and 255.

A detailed description of the cryogenic receiver, as set forth below, is made with reference to FIGS. 5A–5E.

Figure 5B:
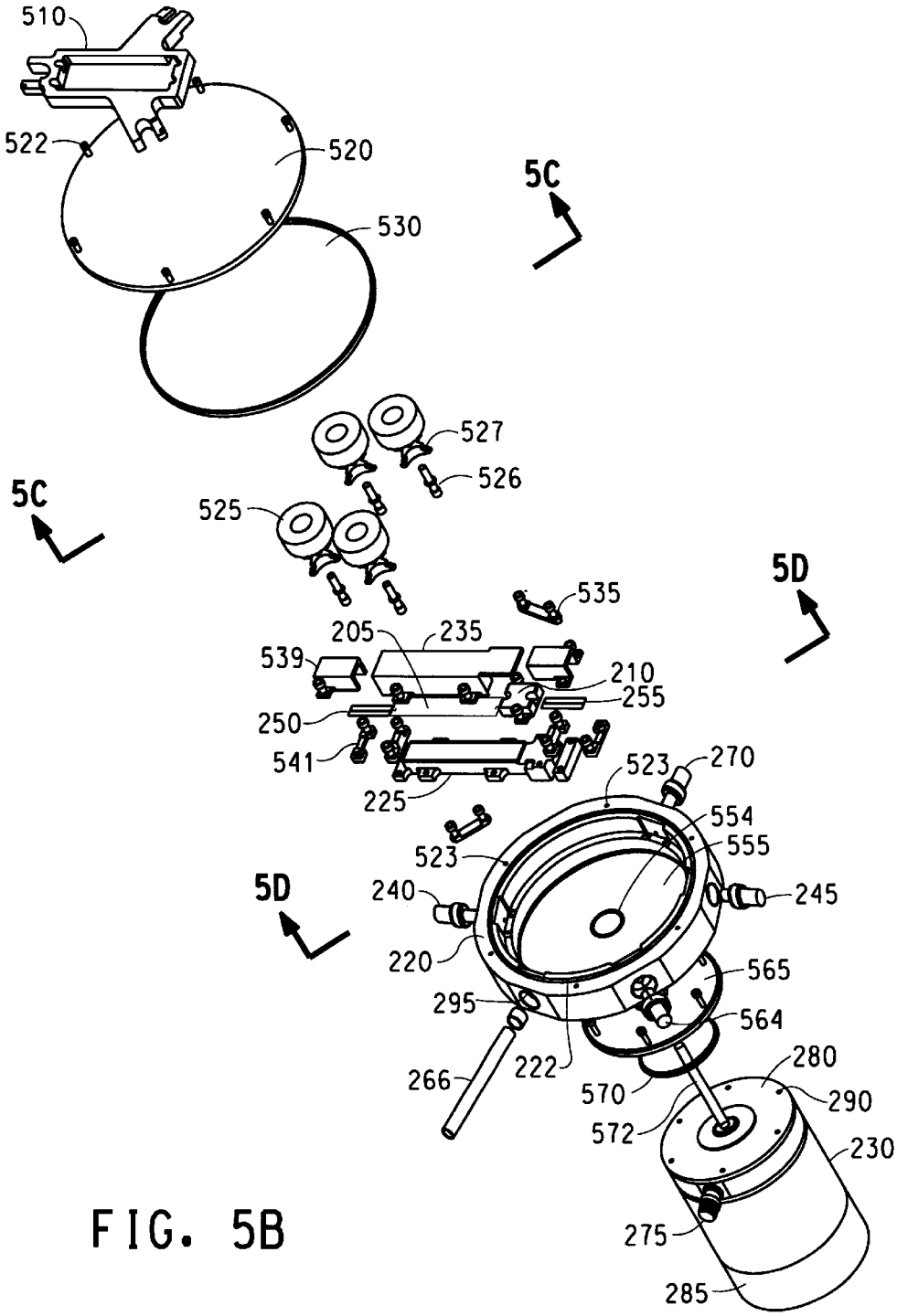
FIG. 5B shows front-tilted exploded perspective view of the embodiment shown in FIG. 5A of the present invention.
Figure 5C:
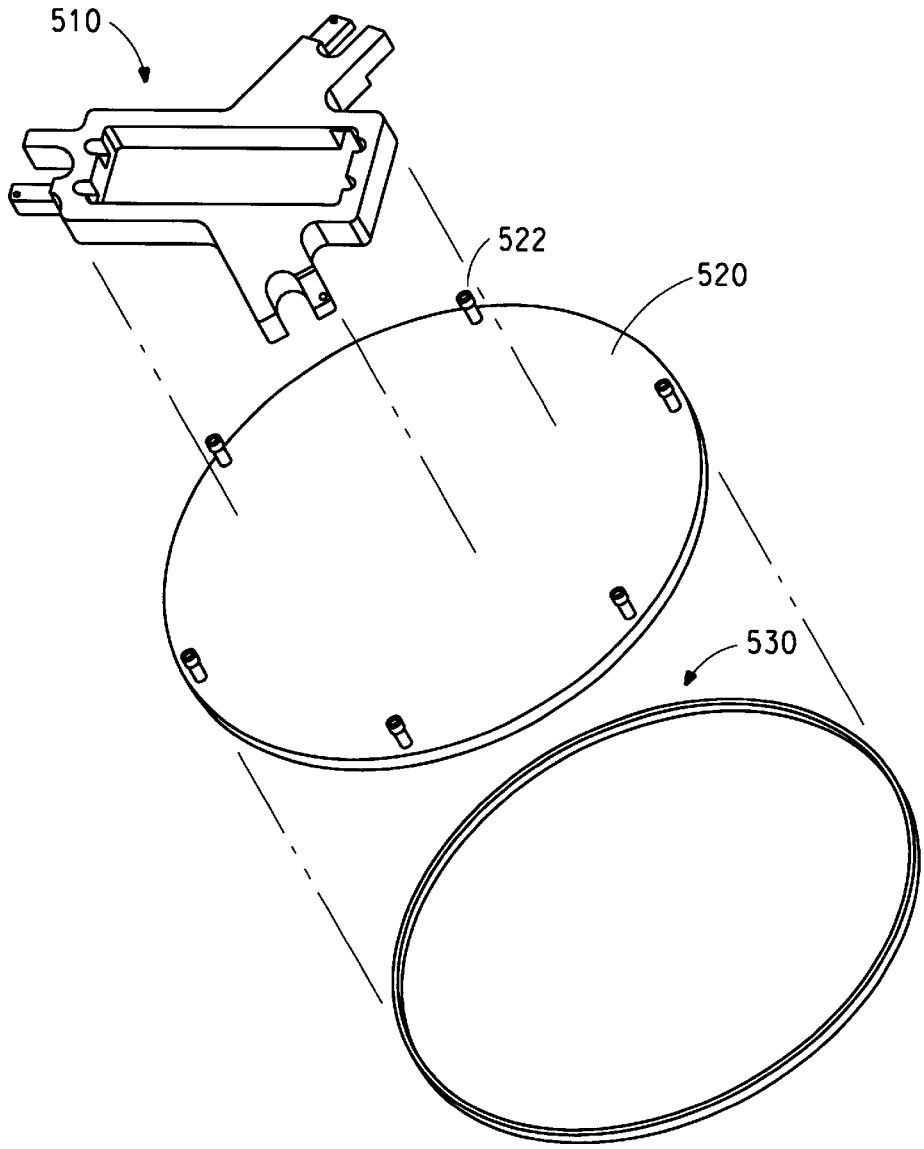
FIG. 5C is an expanded front-tilted perspective view of the embodiment shown in FIG. 5B of those elements above cut line 5C—5C of the present invention.
Figure 5D:
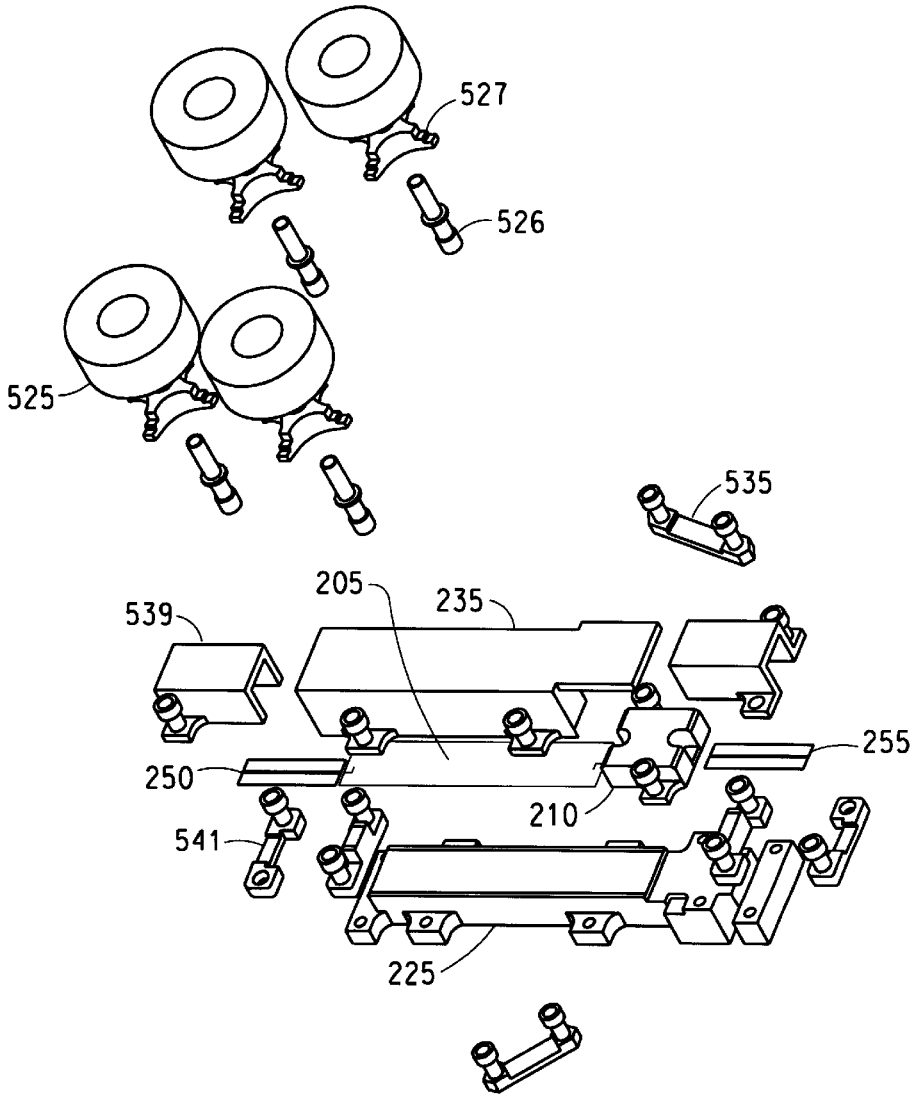
FIG. 5D is an expanded front-tilted perspective view of the embodiment shown in FIG. 5B of those elements above cut line 5D—5D and below cut line 5C—5C of the present invention.
Figure 5E:
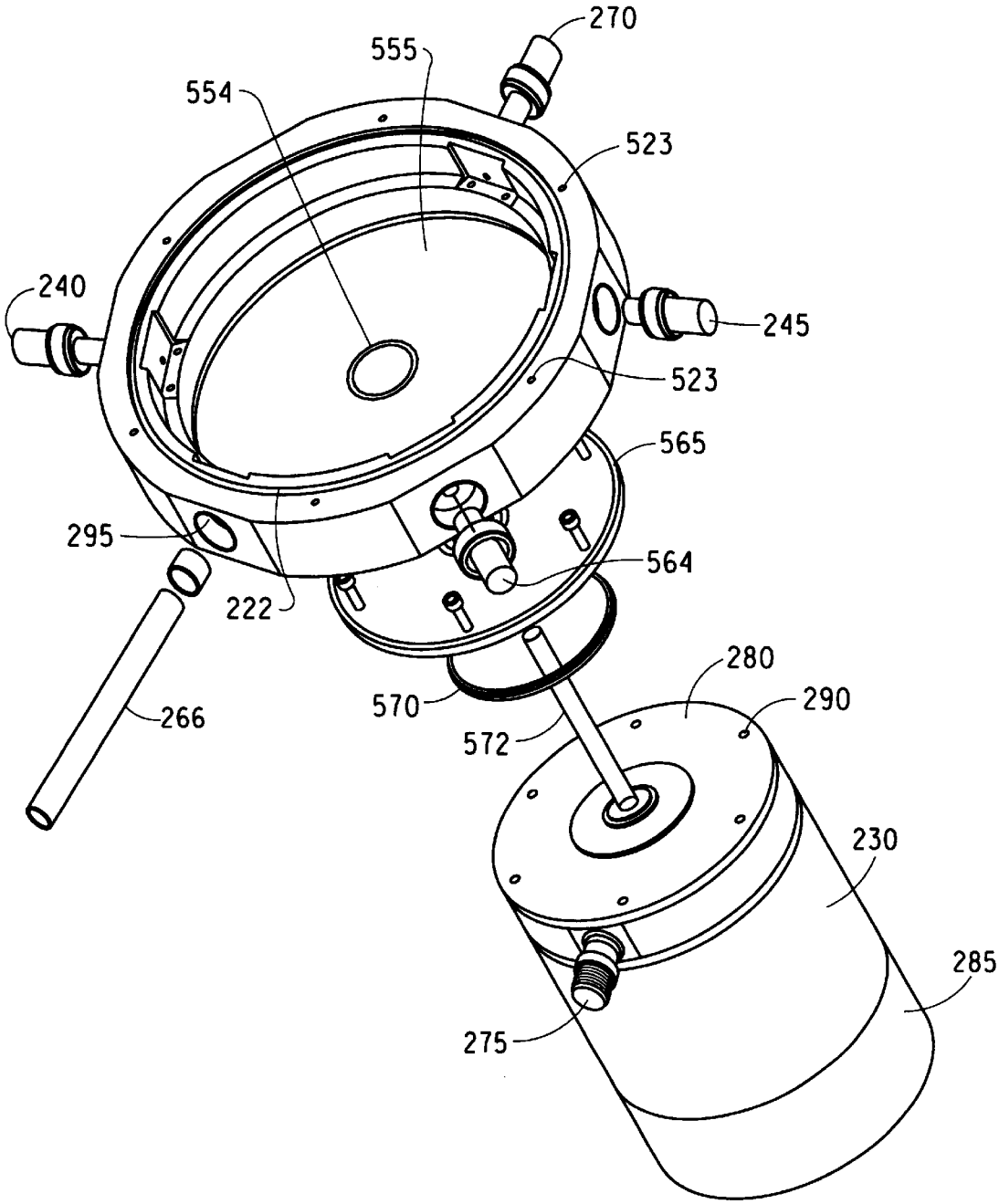
FIG. 5E is an expanded front-tilted perspective view of the embodiment shown in FIG. 5B of those elements below cut line 5D—5D of the present invention.

FIG. 5A depicts a front-tilted perspective view of the hermetically sealed cryogenic receiver of the present invention and FIG. 5B depicts a front tilted exploded perspective of FIG. 5A. The assembly of the cryogenic receiver is as described below with reference to FIGS. 5A–5E, respectively.

The lid 520 of the vacuum dewar assembly 215 is capable of being attached to the dewar body 220 by welding, soldering or mechanical connection. As shown in FIG. 5B, screws 522 are inserted through holes in lid 520 and engage body 220 via screw holes 523. An "O-ring" seal 530 is placed in groove 222 and forms a seal when lid 520 is engaged via screws 522 with body 220.

The O-ring seal 530 is capable of being made of, but is not limited to, rubber, a synthetic material or metal as required to maintain the vacuum conditions. In an alternate embodiment, the attachment of the lid 520 is accomplished by soldering, and O-ring seal 530 is typically made of metal. In a further embodiment of the present invention, wherein some of the components are heat sensitive, thereby rendering conventional welding or soldering techniques difficult to utilize, a "cold" welding technique is capable of being employed in which a malleable metal O-ring (such as one constructed of indium) is placed between the lid 520 and dewar body 220, and the seal is formed by application of pressure to lid 520 to compress the O-ring 530 into groove 222.

Getter 525, which absorbs gases left behind once the dewar body 220 has been evacuated via vacuum tube 266, is held in place by fastener 526 which engages base 527. In this embodiment there are four getters 525 as illustrated, but any number may be used as long as the getter has sufficient capacity to absorb the expected impurities encumbered over the life of the cryogenic unit.

Cold plate 225 is housed within the internal cavity area 555 formed within body 220. Alignment tool 510 is utilized to align cold plate 225 with the body 220 of the unit. Tool 510 is removed once cold plate 225 is adequately secured within cavity 555. Filter 205 and active semiconductor circuit (such as an amplifier) 210 are placed on cold plate 225 or in close proximity to cold plate 225. RF shield (thermal/infrared heat shield) 235 is placed in communication with cold plate 225 and shields filter 205 and amplifier 210. Brackets 535, 539 and 541 are utilized to hold cold plate 225, filter 205 and amplifier 210 (i.e. front-end receiver) in their respective positions within cavity 555. All cryogenic and non-cryogenic surfaces inside the cavity 555 are preferably plated with a highly reflective material such as, for example, gold, platinum, silver or similar type metal (i.e., highly conductive metal with low reactivity to the environment). Jumpers 250 and 255 are in communication with filter 205 and amplifier 210.

Various inputs and outputs are made accessible to the receiver via port 240 ($RF_{in}$), 245 ($RF_{out}$) and 270 ($DC_{in}$). Temperature indication inside of the unit is provided via port 564. Inputs for controlling the cryocooler are made accessible through port 275.

Cold finger 572 extends through central opening 554 of cavity 555 and is in thermal communication with cold plate 225. Cold finger 572 extends from the top 280 of cryocooler 230 (i.e. heat sink region). O-ring 570 forms a seal with 280 when bottom plate 565 is secured via bolts or screws to bolt or screw holes 290 formed in cryocooler top portion 280.

As an example of taking a number of heat budget factors into consideration, by keeping the HTS filter element <40 $cm^2$ in size, the active semiconductor circuit <350 mW dissipated power, and the thermal leak produced by the jumpers (a microstrip transmission line on a 5 cm long, 0.005" (0.127 mm) thick, and 5 mm wide fused silica substrate) to <100 mW, one can reduce the cooling capacity required per channel to <600 mW at 80 K at 20° C. ambient temperature.

As indicated previously, jumpers 250 and 255 are preferably a microstrip transmission line formed on a fused silica or silica aerogel substrate, which are very low thermal conducting substrates and can effectively be used in a long life vacuum environment due to their absence of outgassing materials which could degrade the vacuum over time and increase the heat load to the cooler due to thermal conduction by the outgassed materials. Additionally, an added benefit to an aerogel substrate is that the material is essentially a large surface area silica material. Silica surfaces tend to absorb water vapor, thus improving the quality of the vacuum. Silica materials such as fused silica or silica aerogel are optimum electrical and thermal interfaces and act as a "getter" helping to maintain the required vacuum in the dewar and thus improving vacuum reliability.

In an alternate embodiment, jumpers 250 and 255 comprise a microstrip transmission line (such as a 1.5 $\mu$m thick gold line) deposited on one side of a fused silica substrate which is typically 5 cm long, 2.5–5 mm wide and 0.005 inches (0.127 mm) thick, with the other side of the substrate having a grounding layer (e.g., a conductive metal such as gold) thereon.

Conventional waveguide cavities made entirely out of conductive metals tend to produce too large a thermal leak to the cryogenic electronic portion for applications in the frequency range of less than approximately 2 GHz. Thus, it is recommended (when a waveguide is applicable) to construct the waveguide cavity from a metal coated substrate having a low thermal conductivity (e.g., aerogel) or, at a minimum, to insert a "thermal break" of metal coated aerogel material into the waveguide cavity structure to reduce the conductive thermal transfer.

The HTS filter element may be one or more mini-filter(s) capable of meeting the size limitations imposed by the configuration of the vacuum dewar assembly. Preferred mini-filters are disclosed in previously incorporated U.S. Pat. No. 6,108,569, and are based on self-resonant spiral resonators of varying shapes, including but not limited to rectangular, rectangular with rounded corners, polygon, hairpin, oval and circular. The size of the self-resonant spiral resonator is reduced by reducing the width of the gap between adjacent lines and reducing the center open area in the spiral resonator. The resonant frequency ($f$) of the self-resonant spiral resonator can be changed by changing the length of the spiral line ($\lambda$) (wherein. $f \approx \lambda/2$), changing the gap width between the adjacent lines of the spiral and by placing a conductive tuning pad at the center of the spiral. The last method can be used as fine frequency tuning. Frequency tuning can also be accomplished through the use of an HTS plate positioned above the filter element, and operating temperature variations, as discussed above.

The design of the HTS filter element further depends on a number of factors such as, for example, the purpose of the filter element (e.g., band pass or band reject), operating frequency, sensitivity and other factors recognizable by those of ordinary skill in the art. Based on these factors, one of ordinary skill in the art can design an appropriate filter element using the guidance provided in previously incorporated U.S. Pat. No. 6,108,569 and standard design tools such as commercially available software packages (for example, Sonnet EM Suite available from Sonnet Software, Inc.).

In various embodiments, the superconducting materials of the HTS filter element (and other components comprising superconducting materials) have a transition temperature, $T_c$, greater than about 77 K. In addition, substrates for the HTS filter element should have a dielectric material lattice matched to the HTS film deposited thereon, with a loss tangent less than about 0.0001. Specific preferred materials include (but are not limited to) the following: HTS materials—one or more of $YBa_2Cu_3O_7$, $Tl_2Ba_2CaCu_2O_8$, $TlBa_2Ca_2Cu_3O_9$, $(TlPb)Sr_2CaCu_2O_7$ and $(TlPb)Sr_2Ca_2Cu_3O_9$; and substrate materials—one or more of $LaAlO_3$, MgO, $LiNbO_3$, sapphire and quartz. In addition to the substrate and HTS materials, various buffer and orientation layers can be utilized where appropriate, such as (for example) disclosed in U.S. Pat. Nos. 5,508,255 and 5,262,394, both of which are incorporated herein for all purposes as if fully set forth.

The input and output couplings of the spiral resonator-based mini-filter have two generally accepted configurations. One is a parallel line configuration, which comprises a transmission line with one end connected to the mini-filter's connector via a normal metal contact pad on top of the line, the other end of the line being extended to be close by and in parallel alignment with the spiral line of the first resonator (for the input circuit) or the last resonator (for the output circuit) to provide the input or output couplings for the filter. The other is an inserted line configuration, which comprises a transmission line with one end connected to the mini-filter's connector via a normal metal contact pad on top of the line, with the other end of the line being extended to be inserted into the split spiral line of the first resonator (for the input circuit) or the last resonator (for the input circuit) to provide the input or output couplings for the filter. Further details can be found by reference to previously incorporated U.S. Pat. No. 6,108,569.

The inter-resonator couplings between adjacent spiral resonators in the mini-filter are provided by the overlapping of the electromagnetic fields at the edges of the adjacent resonators. The coupling strength can be adjusted by changing the longitudinal distance between adjacent spiral resonators, changing the orientation of the spiral resonators and shifting the spiral resonator's location along the transverse direction. The last way can be used for fine adjustment of the coupling strength. Again, further details can be found by reference to previously incorporated U.S. Pat. No. 6,108,569.

The mini-filter is preferably in intimate contact with the cold plate 225 of the vacuum dewar assembly 215 via a metallized ground plane on the "back" side of the mini-filter substrate, further details of which can be seen by reference to previously incorporated U.S. Pat. No. 6,108,569. The mini-filter and active semiconductor circuit can be affixed to the cold plate 225, for example, by using conductive epoxy or solder between the metallized ground plane and the cold plate 225, or by resistive welding of the metallized ground plane to the cold plate 225, or simply by mechanical means such as screws.

The active semiconductor circuit 210 may be connected to the filter element 205 by any conventional means such as soldering, wire bonding or parallel gap welding, but is typically connected by a short metal wire which is attached by solder, thermal compression bonding or resistive welding from contact pads (not shown) on the active semiconductor circuit 210 to the contact pads not shown) on the filter element 205.

The active semiconductor circuit 210 may, for example, be one or a combination of amplifiers, mixers, analog-to-digital converters and digital processors. Typically for a receiver, the active semiconductor circuit 210 will comprise an amplifier such as, but not limited to, an InP or GaAs HEMT, HBT, pHEMT, nHEMT, III–V heterostructure or monolithic microwave integrated circuit (MMIC) amplifier. Such amplifiers are well known in the art. An InP or GaAs pHEMT or nHEMT amplifier is typically preferred. Commercially available examples are available from a number of sources such as, for example, Miteq Inc. (Hauppauge, N.Y. USA, Model No. SAFS1-01500200-08-CR-S) and Microwave Technology Inc. (Fremont, Calif. USA, Model No. SG0-7446, Part No. 01-50-660).

The cryogenic source of the cryogenic device provides cooling to the cryogenic electronic components. The cryogenic source can, if the device is deployed in outer space, be the ambient outer space conditions, but the cryogenic source is typically a miniature cryocooler unit 230 of the appropriate size and power requirements. Such miniature cryocoolers are typically Stirling cycle machines such as those described in U.S. Pat. No. 4,397,155, EP-A-0028144, WO90/12961 and WO90/13710 (all of which are incorporated by reference as if fully set forth herein).

The above-described cryogenic devices can be utilized in a number of fields, and particularly in the wireless communications field in band-pass and band-reject filter applications. One such area is in a wireless communication base station receiver front-end in ground-based and tower top applications. General details on such uses can be found in the previously incorporated references. In such uses, the cryogenic front-end receiver of the present invention can be an integrated package similar in certain general respects to conventional units (such as depicted in FIG. 1), in that it comprises a cryogenic electronic unit and control circuitry in a single enclosure, which can be further electrically connected to other components of the base station either directly or remotely. Because of the inventive features of the cryogenic electronic unit described herein, however, the size, weight and power requirements of a front-end receiver in accordance with the present invention can be significantly reduced, in some cases by an order of magnitude or greater, while maintaining equivalent or even better performance, as compared to such conventional units.

The significant reduction in size, weight and power requirements makes the cryogenic devices in accordance with the present invention ideal for integration into, for example, antenna assemblies, satellite base stations, radar arrays and RF receivers.

A specific example of such includes an integrated antenna assembly, wherein the cryogenic device and at least one antenna of a wireless base station are assembled as an integrated unit. In contrast to systems depicted in previously incorporated U.S. Pat. No. 6,104,934, wherein the cryogenic electronic portion of the unit can be in close proximity to the antenna, the present inventions allows an integrated unit with the antenna even further reducing noise contamination to the system.

Figure 6A:
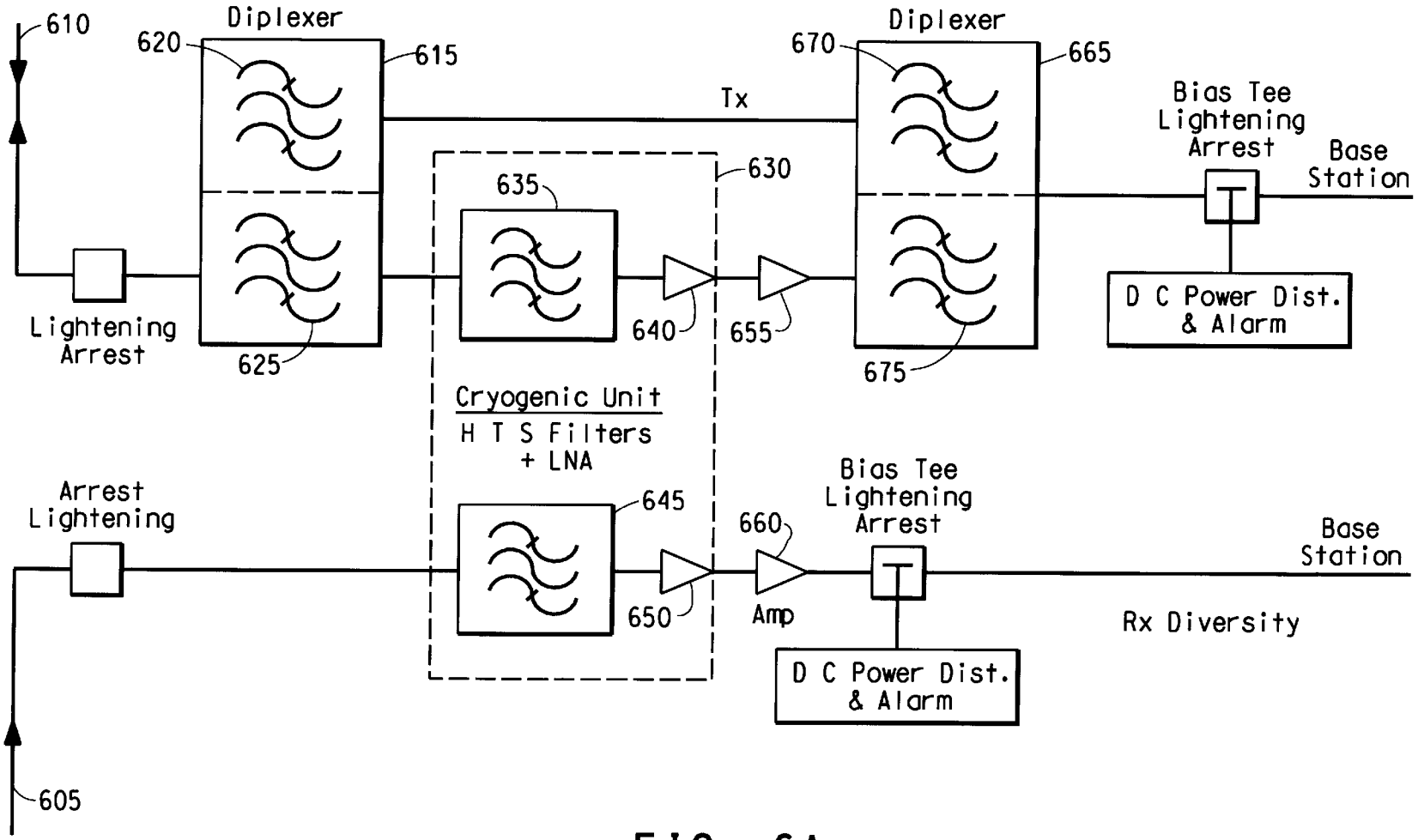
FIG. 6A depicts a schematic circuit diagram of a cryogenic receiver including a main antenna and a diversity receiver antenna input configuration of an embodiment of the present invention.

FIGS. 6A–6F represent several embodiments of a wireless communication base station and self-tuning cryogenic front-end receiver. FIG. 6A depicts a schematic diagram of a wireless base station cryogenic receiver configuration including diversity antenna 605 and main antenna 610. Diversity antenna 605 provides additional gain of approximately 3 db over that of the signal received via main antenna 610. Main antenna 610 receives and transmits simultaneously, whereas diversity antenna only receives signals. The corresponding signals are transmitted directly to cryogenic unit 630 in the case of the diversity antenna 605 and to diplexer 615 for the main antenna 610 before being forwarded to the cryogenic unit 630.

Diplexer 615 is comprised of filters 620 and 625 for separating the signal into its transmission signal component and the received signal component. The received signal component is then transmitted to the cryogenic unit 630. In the general case, the transmission signal is not processed through the cryogenic unit, because of heating capacity constraints, but otherwise can be processed by the cryogenic unit 630. In this embodiment cryogenic unit 630 is comprised of HTS filters 635 and 645 with amplifiers 640 and 650 respectively. Generally, amplifiers are low-noise-amplification (LNA) amplifiers. The filtered and amplified received signal is then forwarded to amplifiers 655 and 660, respectively, and in the case of the main antenna 610 electrical pathway, diplexed with the transmission component of the signal by diplexer 665 comprised of filters 670 and 675 and then is transmitted to the base station.

Figure 6B:
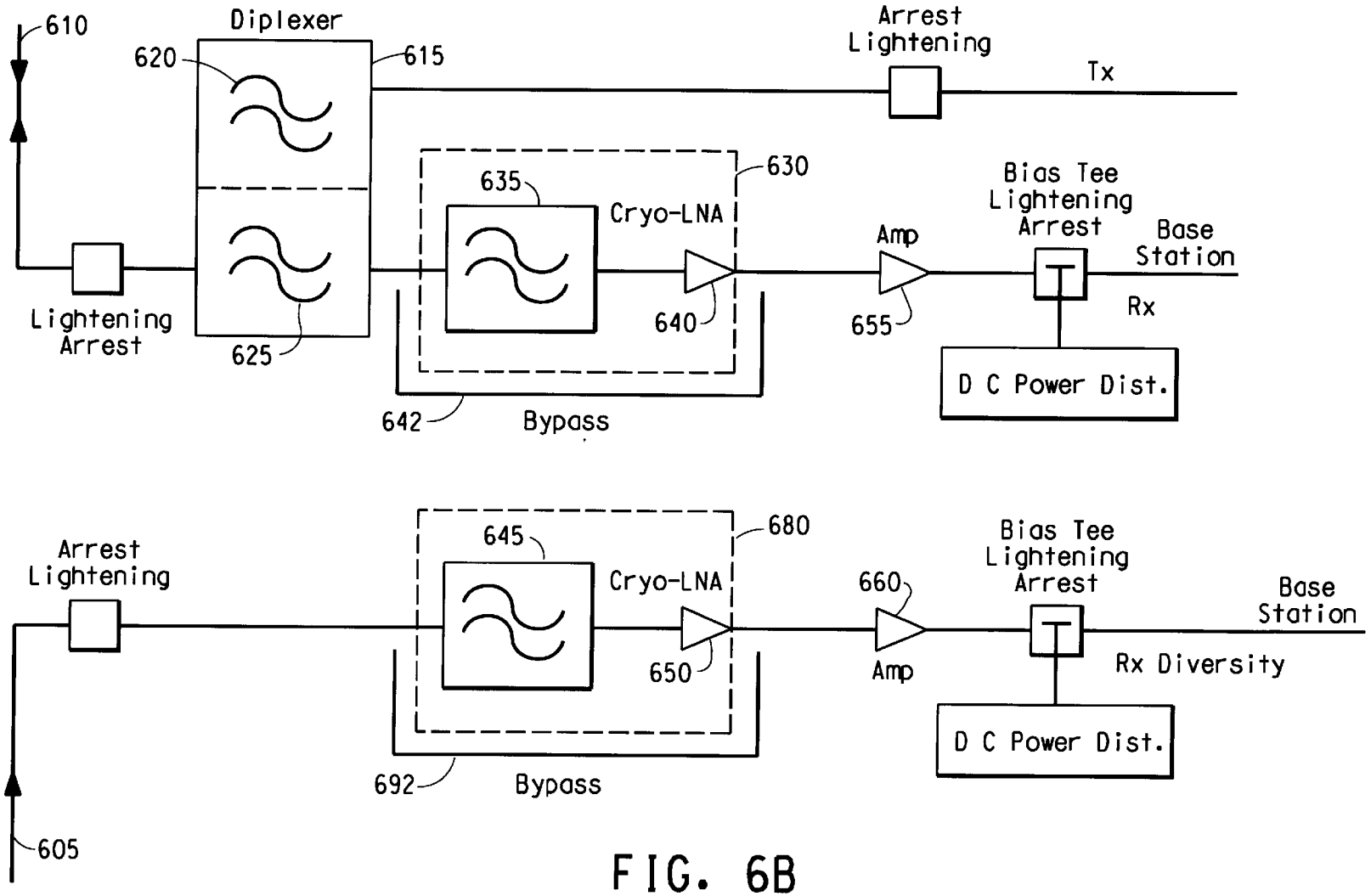
FIG. 6B depicts a schematic circuit diagram of a cryogenic receiver including a main antenna and a diversity receiver antenna input configuration with multiple receiver inputs and a bypass circuit configuration of an alternate embodiment of the present invention.

FIG. 6B depicts a second embodiment of the wireless base station and cryogenic receiver configuration of the present invention. FIG. 6B differs from the embodiment depicted in FIG. 6A in that cryogenic units 630 and 680 are dedicated to the main antenna 610 signal and the diversity antenna 605 signal, respectively. This configuration provides for added reliability and also includes bypass circuits 642 and 692, respectively to further insure that if one or both cryogenic units 630 and 680 fail that the base station will still receive and process the RF signals.

Figure 6C:
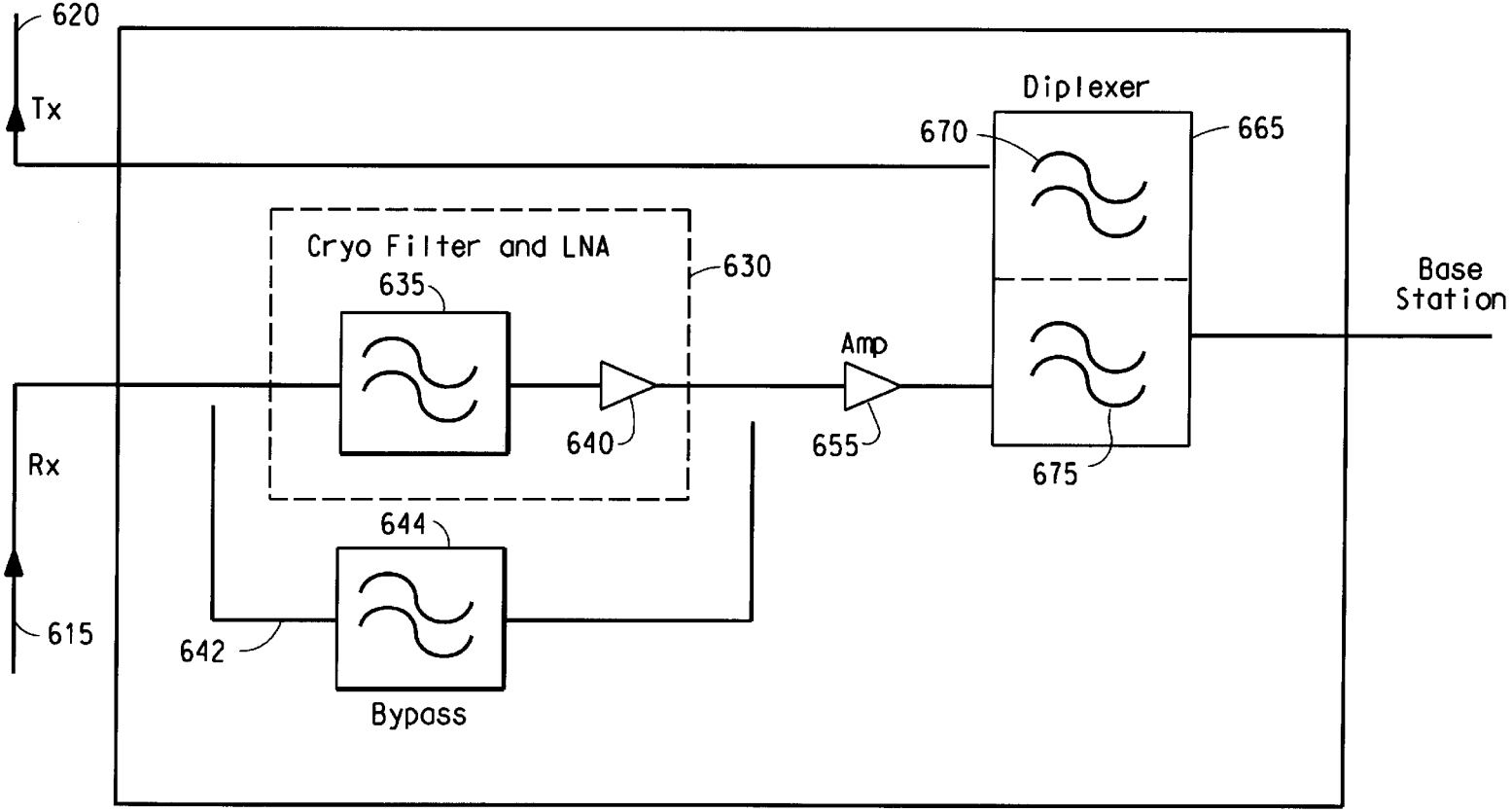
FIG. 6C depicts a schematic circuit of a cryogenic receiver including a transmit antenna and a receive antenna input including a bypass circuit and filter configuration of an alternate embodiment of the present invention.

FIG. 6C depicts a third embodiment of the wireless base station and cryogenic receiver configuration of the present invention, wherein the receive antenna 615 signal is the only signal that is processed by cryogenic unit 630. Also depicted is transmit antenna 620. Additionally, bypass circuit 642, further includes a filter 644, thus providing additional reliability and filtering along this path, not provided in either of the embodiments depicted in FIGS. 6A or 6B.

Figure 6D:
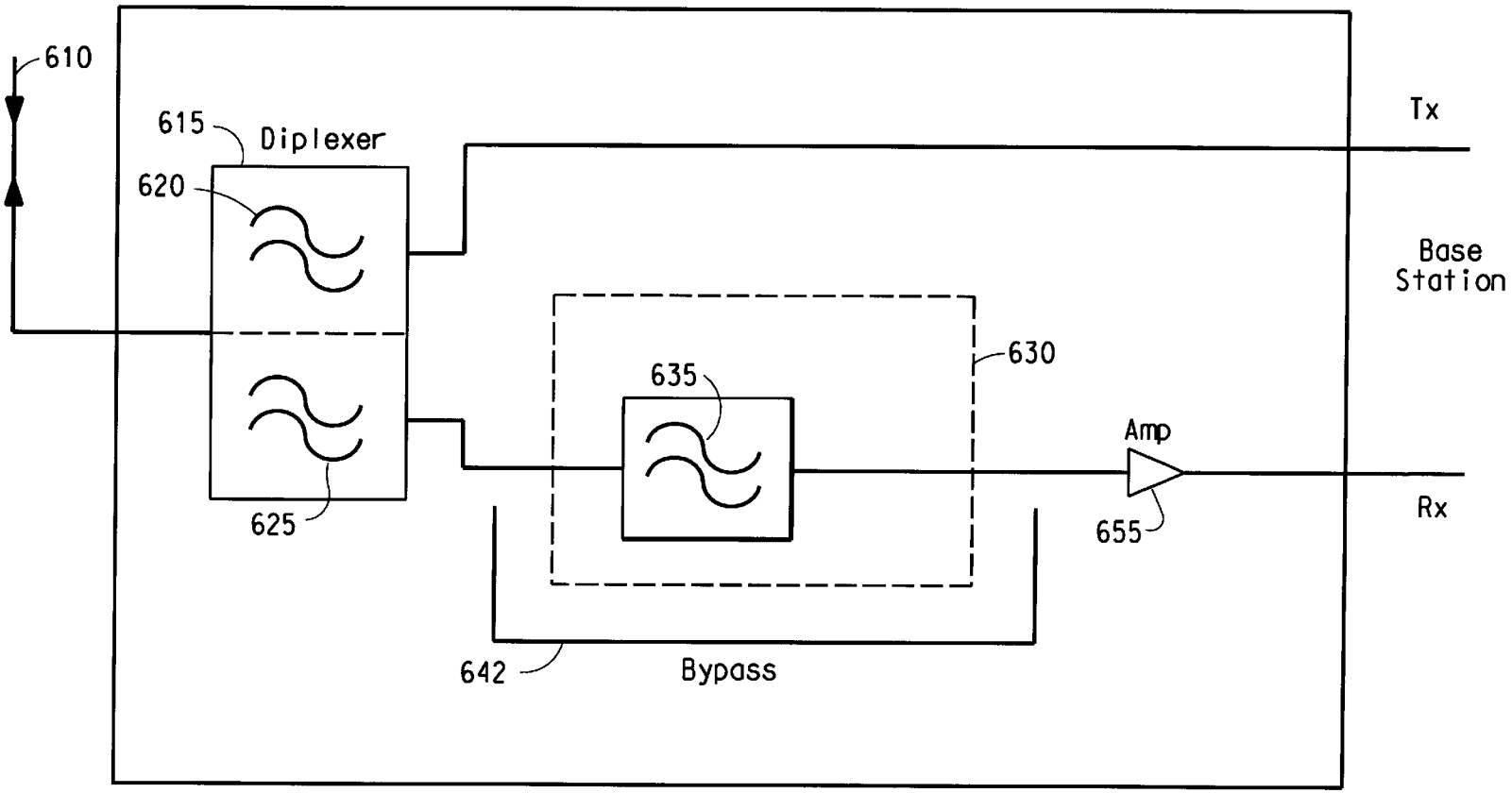
FIG. 6D depicts a schematic circuit diagram of a cryogenic receiver including a main antenna input, a bypass circuit configuration and no active semiconductor circuit, i.e., amplifier, in the cryogenic unit, of an alternate embodiment of the present invention.

FIG. 6D depicts a fourth embodiment of the wireless base station and cryogenic receiver configuration of the present invention. FIG. 6D does not include the diversity antenna of the embodiments depicted in FIGS. 6A–6B and has no active semiconductor circuit (e.g.low-noise amplifier) inside the cryogenic unit. This embodiment includes bypass 642 without filter 644 of the embodiment shown in FIG. 6C, but functions in all other respects as the previous embodiments.

Figure 6E:
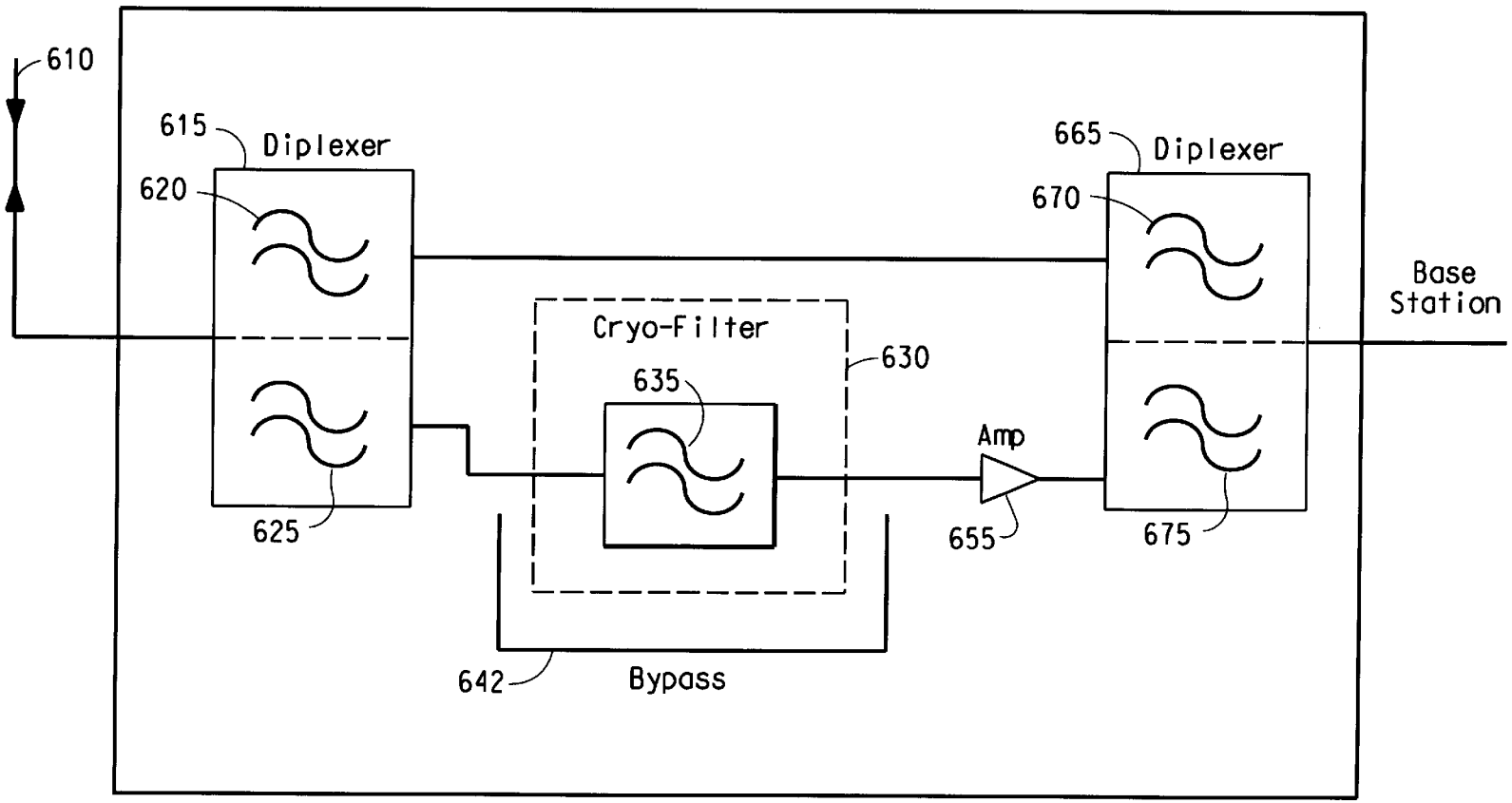
FIG. 6E depicts a schematic circuit of a cryogenic receiver including a main antenna input with multiple diplexers, a bypass circuit configuration and no active semiconductor circuit, i.e., amplifier, in the cryogenic unit of an alternate embodiment of the present invention.

FIG. 6E depicts a fifth embodiment of the wireless base station and cryogenic receiver configuration of the present invention. FIG. 6E differs from the fourth embodiment in that it includes diplexer 665 in the circuit before the signal is forward to the remaining sections of the base station but, like the fourth embodiment, has no active semiconductor circuit (e.g. low-noise amplifier) inside the cryogenic unit.

Figure 6F:
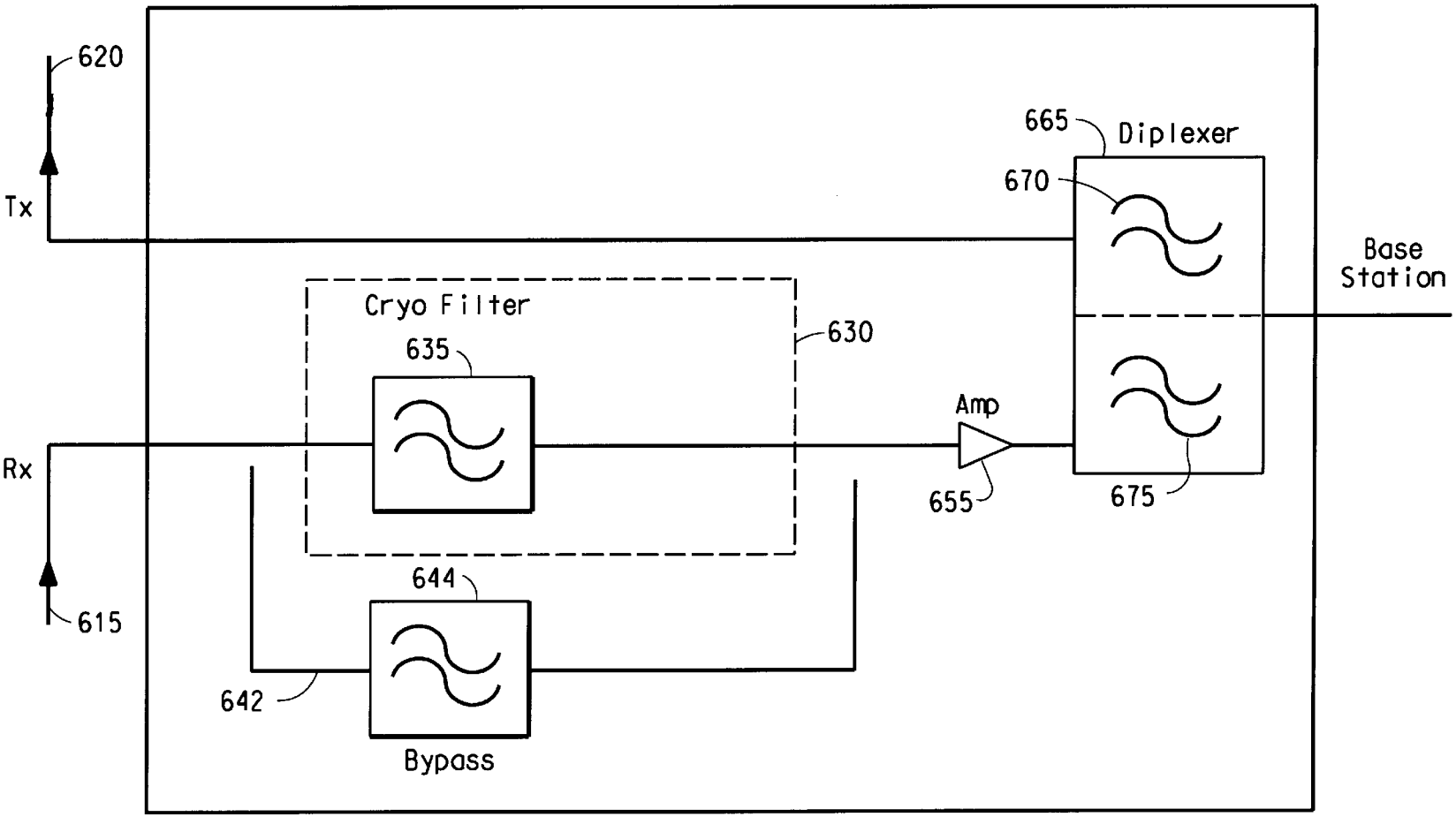
FIG. 6F depicts a schematic circuit of a cryogenic receiver identical to that shown in FIG. 6C except that there is no active semiconductor circuit, i.e., amplifier, in the cryogenic unit.

FIG. 6F depicts a sixth embodiment of the wireless base station and cryogenic receiver configuration of the present invention. FIG. 6F depicts a configuration wherein only the receive antenna 615 signal is processed by cryogenic unit 630. The embodiment further includes bypass circuit 642 with bypass filter 644 and a diplexer 665 before transmitting the processed signal to the remaining sections of the base station. This embodiment differs from the third embodiment shown in FIG. 6C in that the present embodiment has no active semiconductor circuit (e.g. low-noise amplifier) inside the cryogenic unit.

The reader should note that the above embodiments are exemplary and are not intended to limit the scope of the present invention. The present invention can be applied in any environment wherein RF signals (and particularly microwave) are received and broadcast, such as but not limited to, radar arrays, satellite installations (home or commercial) and wireless and cellular base stations. In such uses, the cryogenic devices in accordance with the present invention can provide one, two, three or even significantly higher dB gains in an output signal-to-noise ratio, depending on the use and component configuration.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A cryogenic device comprising:

(a) a cryogenic electronic portion contained within a vacuum dewar assembly, the cryogenic electronic portion having an input end and an output end;

(b) an ambient to cryogenic input connector having an ambient end, and passing into the vacuum dewar assembly to a cryogenic end connected to the input end of the cryogenic electronic portion, (c) a cryogenic to ambient output connector having a cryogenic end connected to the output end of the cryogenic electronic portion, and passing out of the vacuum dewar assembly to an ambient end; and (d) a cryogenic source connected to the vacuum dewar assembly and in intimate contact with the cryogenic electronic portion, wherein:

(e) the cryogenic electronic portion comprises at least one of a high temperature superconductor filter element and a cryogenic active semiconductor circuit, (f) an active semiconductor circuit, if present, produces a total dissipated power into the cryogenic electronic portion of less than about 850 mW, and (g) the cryogenic source has a maximum cooler lift of less than about 3 W at 80 K at an ambient temperature of 20° C.

2. The cryogenic device of claim 1, wherein the cryogenic electronic portion comprises a high temperature superconductor filter element having an input end and an output end, and an active semiconductor circuit having an input end and an output end, wherein:

the input end of the active semiconductor circuit is connected to the cryogenic end of the input connector via the high temperature superconductor filter element;

the input end of the filter element is connected to the cryogenic end of the input connector; and the output end of the filter element is connected to the input end of the active semiconductor circuit.

3. The cryogenic device of claim 1, wherein the cryogenic electronic portion comprises an active semiconductor circuit selected from one or a combination of an amplifier, a mixer, an analog-to-digital converter and a digital processor.

4. The cryogenic device of claim 3, wherein the active semiconductor circuit is a cryogenic amplifier.

5. The cryogenic device of claim 1, wherein the cryogenic electronic portion comprises a high temperature superconductor filter element comprising one or more mini-filters based on self-resonant spiral resonators.

6. The cryogenic device of claim 5, further comprising a superconducting plate above at least the filter element and in intimate contact with the cryogenic source.

7. The cryogenic device of claim 1, wherein one or both of the ambient to cryogenic input connector and cryogenic to ambient output connector is a thermal break.

8. The cryogenic device of claim 1, wherein the cryogenic source is a cryocooler, and the cryocooler and vacuum dewar assembly are formed as an integral unit or assembly.

9. The cryogenic device of claim 1, wherein the cryogenic electronic portion comprises a high temperature superconductor filter element comprising one or more mini-filters based on self-resonant spiral resonators; one or both of the ambient to cryogenic input connector and cryogenic to ambient output connector is a thermal break; the cryogenic source is a cryocooler; and the cryocooler and vacuum dewar assembly are formed as an integral unit or assembly.

10. A cryogenic receiver comprising the cryogenic device of claim 1.

11. The cryogenic receiver of claim 10, wherein the cryogenic source is a cryocooler, and the cryocooler and vacuum dewar assembly are formed as an integral unit or assembly.

12. The cryogenic receiver of claim 10, wherein the cryogenic electronic portion comprises a high temperature superconductor filter element comprising one or more mini-filters based on self-resonant spiral resonators; one or both of the ambient to cryogenic input connector and cryogenic to ambient output connector is a thermal break; the cryogenic source is a cryocooler; and the cryocooler and vacuum dewar assembly are formed as an integral unit or assembly.

13. An integrated antenna assembly comprising the cryogenic receiver of claim 10 and an antenna assembled as an integrated unit.

14. The integrated antenna assembly of claim 13, wherein the cryogenic source is a cryocooler, and the cryocooler and vacuum dewar assembly are formed as an integral unit or assembly.

15. The integrated antenna assembly of claim 13, wherein the cryogenic electronic portion comprises a high temperature superconductor filter element comprising one or more mini-filters based on self-resonant spiral resonators; one or both of the ambient to cryogenic input connector and cryogenic to ambient output connector is a thermal break; the cryogenic source is a cryocooler; and the cryocooler and vacuum dewar assembly are formed as an integral unit or assembly.

16. A communications tower comprising an integrated antenna assembly according to claim 13 located at the top of the tower.

17. A telecommunications network comprising a communications tower according to claim 16.

18. A cryogenic device comprising a cryogenic electronic portion, a non-cryogenic electronic portion and an interconnect connecting the cryogenic electronic portion and the non-cryogenic electronic portion, wherein the interconnect comprises a thermal break between the cryogenic electronic portion and non-cryogenic electronic portions.

19. The cryogenic device of claim 18, wherein the interconnect comprises a microstrip line on a low thermal conductivity substrate.

20. The cryogenic device of claim 19, wherein the substrate comprises one or more of a fused silica and an aerogel.

21. The cryogenic device of claim 18, wherein the cryogenic electronic portion comprises one or both of a high temperature superconductor filter element and a cryogenic active semiconductor circuit.

22. The cryogenic device of claim 18, wherein the cryogenic electronic portion comprises a high temperature superconductor filter element comprising one or more mini-filters based on self-resonant spiral resonators.

23. A method of tuning a high temperature superconducting filter that has an operating temperature and an operating frequency, comprising adjusting the temperature at which the filter operates to induce a shift in the frequency at which the filter operates.

24. A method according to claim 23 wherein adjusting the temperature at which the filter operates induces a shift in center point of the frequency at which the filter operates.

25. A method according to claim 24 wherein the temperature is adjusted by adjusting the operation of a cryogenic cooler.

26. A method according to claim 25 wherein the temperature is raised.

27. A method according to claim 26 wherein the filter is a mini-filter based on self-resonant spiral resonators.

28. A method of tuning a cryogenic receiver that comprises a high temperature superconducting filter, wherein the receiver has an operating temperature and an operating frequency, comprising adjusting the temperature at which the receiver operates to induce a shift in the frequency at which the receiver operates.

29. A method according to claim 28 wherein adjusting the temperature at which the receiver operates induces a shift in center point of the frequency at which the receiver operates.

30. A method according to claim 28 wherein the temperature is adjusted by adjusting the operation of a cryogenic cooler.

31. A method according to claim 28 wherein the temperature is raised.

32. A method according to claim 28 wherein the filter is a mini-filter based on self-resonant spiral resonators.

33. A method of manufacturing a high temperature superconducting filter that has an operating temperature and an operating frequency, comprising (a) designing the filter to operate at a first frequency; (b) preparing the filter and determining, as a second frequency, the frequency at which the filter, as prepared, operates; and (c) adjusting the temperature at which the filter operates to induce a shift therein from the second frequency to the first frequency.

34. A method according to claim 33 wherein adjusting the temperature at which the filter operates induces a shift in center point of the frequency at which the filter operates.

35. A method according to claim 33 wherein the temperature is adjusted by adjusting the operation of a cryogenic cooler.

36. A method according to claim 33 wherein the second frequency is higher than the first frequency.

37. A method according to claim 33 wherein the filter is a mini-filter based on self-resonant spiral resonators.

38. A method of manufacturing a cryogenic receiver that comprises a high temperature superconducting filter, the receiver having an operating temperature and an operating frequency, comprising (a) designing the receiver to operate at a first frequency; (b) preparing the receiver and determining, as a second frequency, the frequency at which the receiver, as prepared, operates; and (c) adjusting the temperature at which the receiver operates to induce a shift therein from the second frequency to the first frequency.

39. A method according to claim 38 wherein adjusting the temperature at which the receiver operates induces a shift in center point of the frequency at which the receiver operates.

40. A method according to claim 38 wherein the temperature is adjusted by adjusting the operation of a cryogenic cooler.

41. A method according to claim 38 wherein the second frequency is higher than the first frequency.

42. A method according to claim 38 wherein the filter is a mini-filter based on self-resonant spiral resonators.

* * * * *